US007316547B2

(12) United States Patent
Lilie

(10) Patent No.: US 7,316,547 B2
(45) Date of Patent: Jan. 8, 2008

(54) RECIPROCATING COMPRESSOR DRIVEN BY A LINEAR MOTOR

(75) Inventor: Dietmar Erich Bernhard Lilie, Joinville (BR)

(73) Assignee: Empresa Brasilera de Compressores S.A. - Embraco, Joinville - SC (BR)

( * ) Notice: Subject to any disclaimer, the term of this patent is extended or adjusted under 35 U.S.C. 154(b) by 423 days.

(21) Appl. No.: 10/506,649

(22) PCT Filed: Mar. 20, 2003

(86) PCT No.: PCT/BR03/00041

§ 371 (c)(1),
(2), (4) Date: Oct. 13, 2004

(87) PCT Pub. No.: WO03/081041

PCT Pub. Date: Oct. 2, 2003

(65) Prior Publication Data

US 2005/0123422 A1 Jun. 9, 2005

(30) Foreign Application Priority Data

Mar. 22, 2002 (BR) ..... 0201189

(51) Int. Cl.
*F04B 17/00* (2006.01)
*F04B 35/04* (2006.01)

(52) U.S. Cl. ..... 417/416; 417/417; 417/415; 417/902

(58) Field of Classification Search ..... 417/415, 417/416, 417, 902
See application file for complete search history.

(56) References Cited

U.S. PATENT DOCUMENTS

| | | | | |
|---|---|---|---|---|
| 5,525,845 | A | 6/1996 | Beale et al. | |
| 5,772,410 | A * | 6/1998 | Chang | 417/417 |
| 6,174,141 | B1 * | 1/2001 | Song et al. | 417/417 |
| 6,231,310 | B1 * | 5/2001 | Tojo et al. | 417/417 |
| 6,966,761 | B1 * | 11/2005 | Roke et al. | 417/417 |

FOREIGN PATENT DOCUMENTS

| | | | |
|---|---|---|---|
| EP | 0 864 750 A1 | | 9/1998 |
| EP | 1 126 171 A2 | | 8/2001 |
| FR | 743 398 A1 | | 3/1933 |
| JP | 10-238461 A1 | | 9/1998 |
| JP | 2001-73942 A1 | | 3/2001 |
| JP | 2001-123949 | * | 5/2001 |
| WO | WO01-29444 | * | 4/2001 |

* cited by examiner

*Primary Examiner*—Ted Kim

(57) ABSTRACT

A reciprocating compressor driven by a linear motor, comprising a shell, within which are mounted: a reference assembly formed by a motor and a cylinder (1); a resonant assembly formed by a piston (2) reciprocating inside the cylinder (1), and by an actuating means (3) operatively coupling the piston (2) to the motor; two spring means (10) mounted to the resonant assembly and to the reference assembly and which are elastically and axially deformed in the displacement direction of the piston (2); a mounting element (40) coupling an end of one spring means (10) to an end of the other spring means (10); and a coupling element (50) mounted to the piston (2) and to the mounting element (40), which is axially displaced together with the piston (2) and displaced freely and transversally to the displacement direction of the piston (2), said coupling element (50) transmitting the axial forces between the piston (2) and the mounting element (40) and minimizing the application of radial forces to the piston (2).

12 Claims, 3 Drawing Sheets

RECIPROCATING COMPRESSOR DRIVEN BY A LINEAR MOTOR

FIELD OF THE INVENTION

This application is a U.S. national phase application under 35 U.S.C. § 371 of International Patent Application No. PCT/BR2003/000041, filed Mar. 20, 2003, and claims the benefit of Brazilian Patent Application No. PI 0201189-1, filed Mar. 22, 2007. The International Application was published as International Publication No. WO 2003/081041 on Oct. 2, 2003 under PCT Article 21(2) the contents of which are incorporated herein in their entirety.

The present invention refers, in general, to a reciprocating compressor driven by a linear motor to be applied to refrigeration systems and presenting a piston reciprocating inside a cylinder. More specifically, the invention refers to a coupling between the piston and a resonant system associated thereto.

BACKGROUND OF THE INVENTION

In a reciprocating compressor driven by a linear motor, the gas suction and gas compression operations are performed by the reciprocating axial movements of each piston inside a cylinder, which is closed by a cylinder head and mounted within a hermetic shell, in the cylinder head being positioned the suction and discharge valves that control the admission and discharge of the gas in relation to the cylinder. The piston is driven by an actuating means that supports magnetic components operatively associated with a linear motor affixed to the shell of the compressor.

In some known constructions, each piston-actuating means assembly is connected to a resonant spring affixed to the hermetic shell of the compressor, in order to operate as a guide for the axial displacement of the piston and make the whole assembly act resonantly in a predetermined frequency, allowing the linear motor to be adequately dimensioned to continuously supply energy to the compressor upon operation.

In a known construction, two helical springs are mounted under compression against the actuating means on each of the sides thereof. The piston forms, jointly with the actuating means and with the magnetic component, the resonant assembly of the compressor, which is driven by the linear motor and has the function of developing a reciprocating linear movement, making the movement of the piston inside the cylinder exert a compressive action on the gas admitted through the suction valve, to the point in which said gas can be discharged to the high pressure side through the discharge valve.

Helical springs under compression, regardless of the shape of the last coil that will form the contact region with the piston, generate a contact force with an uneven distribution along a determined circumferential contact extension, with a compressive force concentration in the region where the last coil starts to contact the piston.

In a known solution (U.S. Pat. No. 5,525,845), the coupling between the helical springs and the piston occurs by the provision of a thin cylindrical rod, which is sufficiently laterally flexible to absorb the lateral movements of the springs, but which is axially rigid to transmit the axial force to the piston.

In another known construction, the helical springs are seated on a disc that is connected to the piston, thus applying all the force to the piston. However, the helical springs not only generate the axial force, but also generate radial forces, and the axial force itself is not concentric to the axis of symmetry of the springs. Such spring imperfections force the piston, causing friction and higher energy consumption, which impairs the performance of the linear compressor.

OBJECT OF THE INVENTION

Thus, it is an object of the present invention to provide a reciprocating compressor driven by a linear motor, which with a simple construction and with a minimum of components with relative movement, minimizes the lateral forces on the piston, the effects of the concentration of compressive forces on the actuating means, and the consequent momenta on both the actuating means and the piston.

SUMMARY OF THE INVENTION

This and other objects are achieved through a reciprocating compressor driven by a linear motor comprising a hermetic shell, within which are mounted: a reference assembly formed by a motor and a cylinder; a resonant assembly formed by a piston reciprocating inside the cylinder, and by an actuating means operatively coupling the piston to the motor; and two spring means mounted to the resonant assembly and to the reference assembly and which are elastically and axially deformed in the displacement direction of the piston, said compressor comprising a mounting element coupling an end of one spring means (10) to an end of the other spring means (10); a coupling element, which has an end mounted to the piston and an opposite end mounted to the mounting element, said mounting element carrying the ends of the two spring means coupled thereto and being axially displaced together with the piston and displaced freely and transversally to the displacement direction of the piston, said coupling element being constructed to transmit the axial forces between the piston and the mounting element, and to minimize the application of radial forces to the piston.

BRIEF DESCRIPTION OF THE DRAWINGS

The invention will be described below, with reference to the enclosed drawings, in which.

DESCRIPTION OF THE ILLUSTRATED EMBODIMENTS

The present invention will be described in relation to a reciprocating compressor driven by a linear motor of the type used in refrigeration systems and comprising a hermetic shell, within which is mounted a motor-compressor assembly including a reference assembly affixed to the inside of said shell and formed by a linear motor and a cylinder 1, and a resonant assembly formed by a piston 2 reciprocating inside the cylinder 1 and by an actuating means 3 external to the cylinder 1 and which carries a magnet 4 to be axially impelled upon energization of the linear motor, said actuating means 3 operatively coupling the piston 2 to the linear motor, and the piston 2, such as illustrated, presenting a piston top portion and a tubular body portion.

Figure 1:
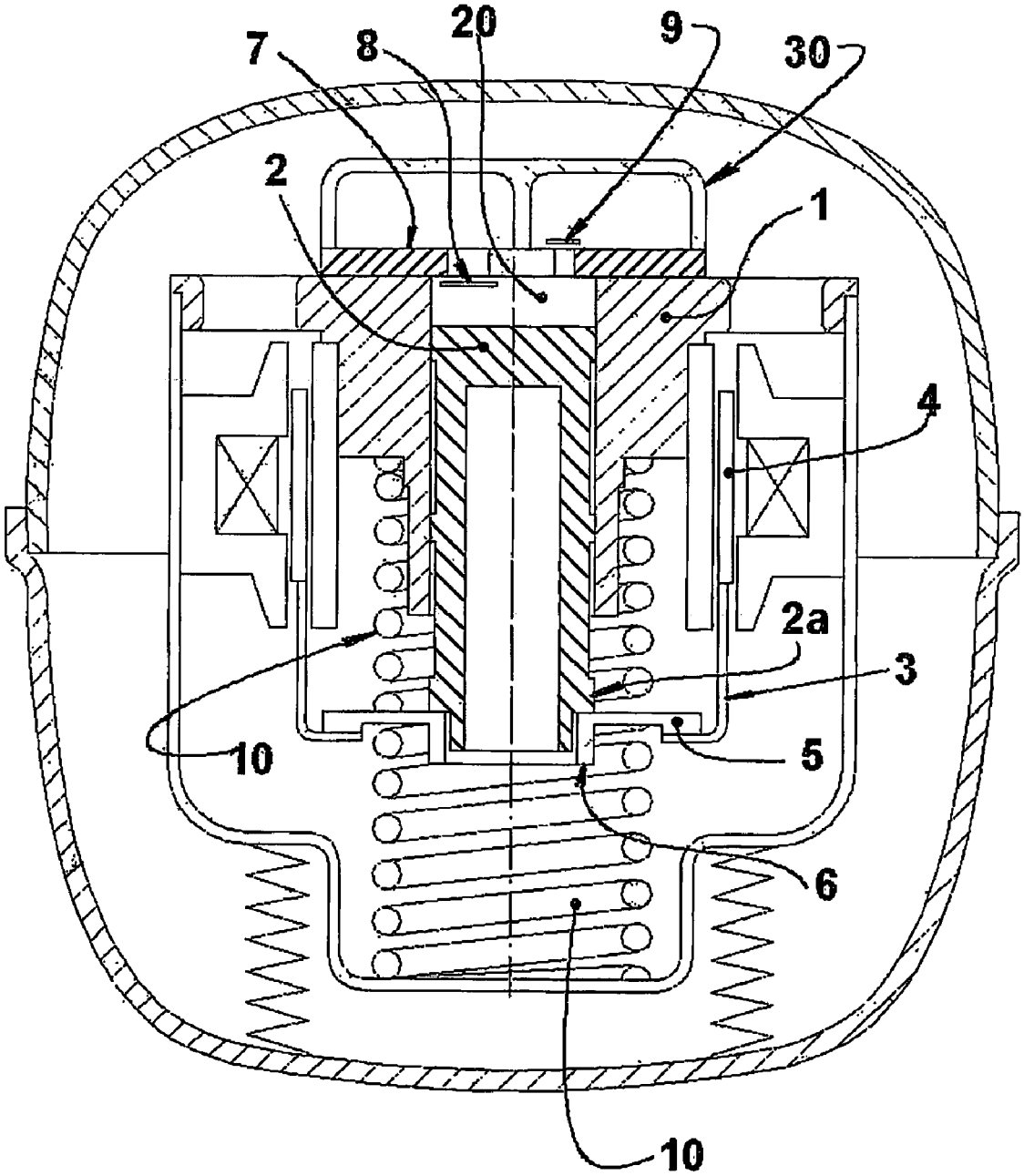
FIG. 1 PRIOR ART
FIG. 1 is a schematic longitudinal diametrical sectional view of a hermetic compressor of the type driven by a linear motor, presenting helical springs compressing a disc element of the actuating means, which couples the piston to the reciprocating linear motor constructed according to the prior art.

In the construction illustrated in FIG. 1, the actuating means carries an annular disc 5, against which is coupled the piston 2, medianly defining a lower neck 6 for the fitting and fixation of a lower portion of the piston 2. In the fitting position, a lower annular flange 2*a* of the piston 2 is seated against a flat upper face of said annular disc 5.

The compressor illustrated in the enclosed figures also includes two spring means 10, mounted under constant compression to the resonant assembly and to the reference assembly and which are elastically and axially deformed in the displacement direction of the piston 2.

In FIG. 1, each spring means 10 is in the form of a helical spring having a respective end mounted to the annular disc 5 of the actuating means 3 and a respective opposite end mounted to one of the resonant and the reference assemblies.

In the embodiment illustrated in FIG. 1, the cylinder 1 has an end closed by a valve plate 7 which is provided with a suction valve 8 and a discharge valve 9, allowing the selective fluid communication between a compression chamber 20 defined between the top of the piston 2 and the valve plate 7 and the respective inner portions of a cylinder head 30 that are respectively maintained in fluid communication with the low and the high pressure sides of the refrigeration system to which the compressor is coupled.

In this construction, during the operation of the piston 2, in the region for the contact and seating of each spring means 10 against the actuating means 3, a reacting compressive force is applied that originates a momentum transmitted to the piston 2, causing misalignments in the latter that result in wear of said piston 2 with time.

According to the present invention, the two spring means 10 are coupled to each other by a mounting element 40, to which is affixed an adjacent end of each of the two spring means 10, said mounting element 40 being axially displaced jointly with the piston 2 and with the adjacent ends of the two spring means 10, and free to be displaced in a plane transversal to the displacement direction of the piston 2, for example by a certain limited extension, jointly with the ends of the two spring means 10 coupled thereto.

The mounting element 40 presents a first annular portion 41, coupling an adjacent end of one of the two spring means 10, and a second portion 42 coupling an adjacent end of the other of said two spring means 10, said first and second portions 41, 42 being axially spaced and affixed to each other and disposed on axially opposite sides of the resonant assembly, and part of the resonant assembly being disposed through said first portion 41.

The mounting element 40 is coupled to the piston 2 by a coupling element 50, having an end mounted to said piston 2 and an opposite end mounted to the mounting element 40, said coupling element 50 being constructed in order to transmit, for example completely, the axial forces between the piston and the mounting element and to minimize the application of radial forces to the piston, for example upon the transversal displacement of the mounting element.

In the illustrated embodiment, the first portion 41 defines an annular housing to receive and affix an end coil of a spring means, and the second portion 42 presents an elevated annular peripheral edge 43 defining, from a face opposite to that turned to the cylinder 1, a housing for an adjacent end of the other spring means 10.

According to the present invention, the fixation between the first and the second portion 41, 42 of the mounting element 40 is obtained by means of rigid elements 44, for example two pairs of rigid pins, which are angularly spaced from each other and mounted, with a radial gap, through the actuating means 3, for example by means of throughbores 5*a* provided in the annular disc thereof.

Figure 2:
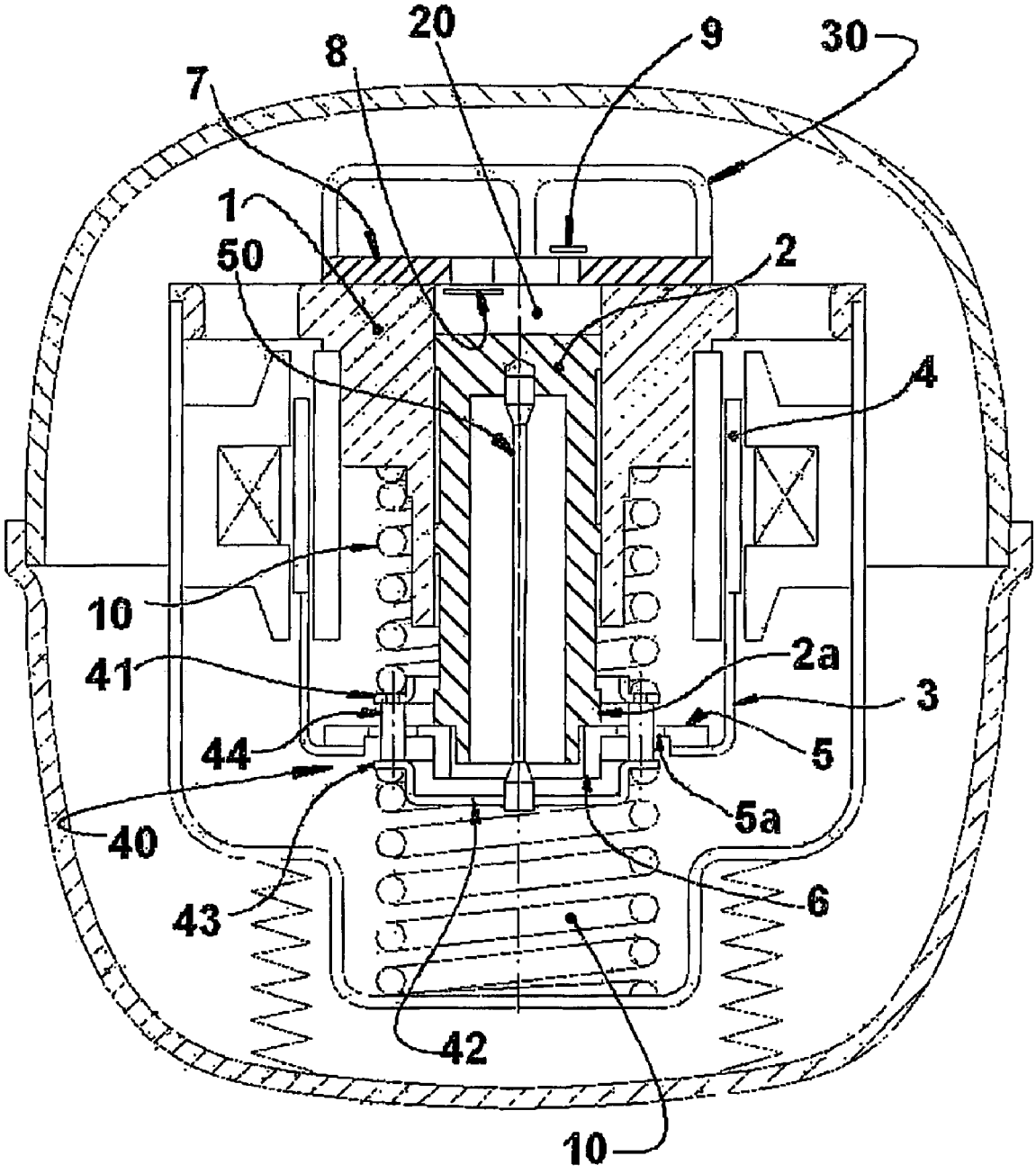
FIG. 2 is a schematic longitudinal diametrical sectional view of a hermetic compressor, such as that illustrated in FIG. 1, but presenting a coupling between the piston and the spring means obtained according to a construction of the present invention.
Figure 3:
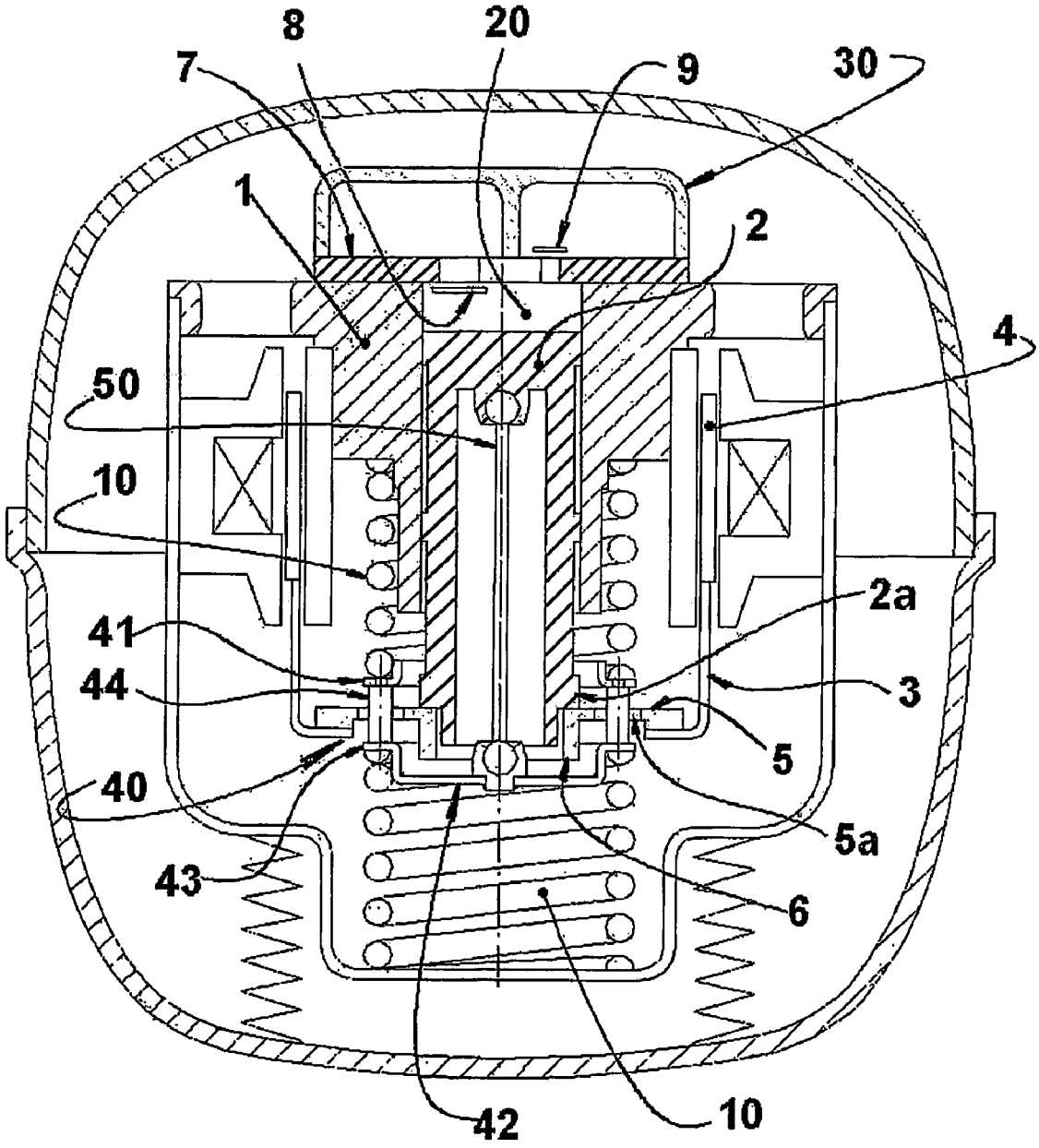
FIG. 3 is a schematic longitudinal diametrical sectional view of a hermetic compressor such as that illustrated in FIG. 1, but presenting a coupling between the piston and the spring means obtained according to another construction of the present invention.

In the embodiment illustrated in FIGS. 2-3, the second portion 42 comprises a disc which couples, from an external face and coaxially to the axis of the piston 2, the coupling element 50, which in the illustrated embodiment is in the form of an elongated and relatively flexible rod presenting, in the constructive option of FIG. 2, its ends respectively affixed to the piston 2 and to the second portion 42 of the mounting element 40 and, in the constructive option of FIG. 3, its ends articulated, for example connected through ball-joints, to the parts defined by the piston 2 and by the second portion 42 of the mounting element 40.

According to the present invention, the coupling element 50 is disposed inside the body of the piston 2, so that an internal end is coupled to the top of said piston 2, and an external end remains slightly projected from the plane of the actuating means, defining to said coupling element 50 a determined extension that is sufficient to provide a relative flexibility to the latter.

The invention claimed is:

1. A reciprocating compressor driven by a linear motor comprising a shell, within which are mounted:

a reference assembly formed by a motor and a cylinder;

a resonant assembly formed by a piston reciprocating inside the cylinder, and by an actuating means operatively coupling the piston to the motor; and two spring means mounted to the resonant assembly and to the reference assembly and which are elastically and axially deformed in the displacement direction of the piston, the reciprocating compressor further comprising:

a mounting element coupling an end of one spring means to an end of the other spring means; and a coupling element which has an end mounted to the piston and an opposite end mounted to the mounting element, wherein:

said mounting element carries the ends of the two spring means coupled thereto and is axially displaceable together with the piston and is displaceable freely and transversally to the displacement direction of the piston, said coupling element is constructed to transmit the axial forces between the piston and the mounting element and to minimize the application of radial forces to the piston, and the mounting element includes a first annular portion coupling an adjacent end of one of the two spring means, and a second portion coupling an adjacent end of the other spring means, said first and second portions being disposed at axially opposite sides of the resonant assembly, and being affixed to each other by rigid elements that are mounted, with a radial gap, through the actuating means.

2. The compressor according to claim 1, characterized in that the coupling element is in the form of an elongated and relatively flexible rod.

3. The compressor according to claim 1, characterized in that the coupling element presents its ends respectively affixed to the mounting element and to the piston.

4. The compressor according to claim 1, characterized in that the coupling element presents its ends respectively articulated to the mounting element and to the piston.

5. The compressor according to claim 4, characterized in that the coupling element has its ends connected through a balljoint to the parts defined by the piston and the mounting element.

6. The compressor according to claim 1, characterized in that part of the resonant assembly is disposed through said second portion.

7. The compressor according to claim 6, characterized in that the coupling element is mounted to the second portion of the mounting element.

8. The compressor according to claim 7 and in which the piston presents a top portion and a tubular portion, characterized in that the coupling element has part of its extension disposed within the body portion of the piston, having an end mounted to the top portion of the piston.

9. The compressor according to claim 8, characterized in that the rigid elements are angularly spaced to each other.

10. The compressor according to claim 1, characterized in that the actuating means carries an annular disc, against which is coupled the piston.

11. The compressor according to claim 10, characterized in that the second portion comprises a disc which couples, from an external face and coaxially to the axis of the piston, the coupling element.

12. The compressor according to claim 11, characterized in that the second portion presents an elevated annular peripheral edge, which defines, from a lower face, a housing for an adjacent end of a spring means.

* * * * *

UNITED STATES PATENT AND TRADEMARK OFFICE

CERTIFICATE OF CORRECTION

PATENT NO. : 7,316,547 B2
APPLICATION NO. : 10/506649
DATED : January 8, 2008
INVENTOR(S) : Dietmar Erich Bernhard Lilie It is certified that error appears in the above-identified patent and that said Letters Patent is hereby corrected as shown below:

On the title page, item [73]
Please delete "Brasilera" and insert --Brasileira--

Signed and Sealed this

Sixth Day of May, 2008

JON W. DUDAS
*Director of the United States Patent and Trademark Office*